United States Patent [19]

Kitchen et al.

[11] 4,207,634

[45] Jun. 17, 1980

[54] BOX SPRING ASSEMBLY WITH END RAIL SPRING MOUNTING UNITS

[75] Inventors: John P. Kitchen; Terry L. Gabhart, both of Georgetown, Ky.

[73] Assignee: Hoover Universal, Inc., Saline, Mich.

[21] Appl. No.: 952,949

[22] Filed: Oct. 20, 1978

[51] Int. Cl.[2] ..... A47C 23/04

[52] U.S. Cl. ..... 5/255; 5/260; 5/475

[58] Field of Search ..... 5/297, 255-260, 5/261, 351, 475; 267/102, 107, 110, 112

[56] References Cited

U.S. PATENT DOCUMENTS

| | | | |
|---|---|---|---|
| 2,593,831 | 4/1952 | Bank | 5/255 |
| 3,680,157 | 8/1972 | Slominski et al. | 5/247 |
| 3,755,833 | 9/1973 | Slominski | 5/247 |
| 3,938,204 | 2/1976 | Slominski | 5/255 |

*Primary Examiner*—Casmir A. Nunberg

*Attorney, Agent, or Firm*—Olsen and Stephenson

[57] ABSTRACT

A box spring assembly with end rail spring mounting units consisting of a frame having wood side and end rails, metal cross rails, and metal end rail mounting units secured to the end rails. The mounting units locate and support some of the springs in the assembly.

3 Claims, 4 Drawing Figures

BOX SPRING ASSEMBLY WITH END RAIL SPRING MOUNTING UNITS

BACKGROUND OF THE INVENTION

U.S. Pat. No. 3,680,157, owned by the assignee of this invention, shows a box spring assembly employing metal side, cross, and end rails. The present invention constitutes an improvement on the box spring assembly shown in the aforementioned U.S. Patent.

Wood frame box spring assemblies presently in use generally consist of wooden side and end rails secured together to form a generally rectangular frame, cross rails extending between the side rails, and a plurality of formed wire springs mounted on the frame. Difficulties have in the past been encountered in assembling the individual springs on the frame in which case placement of the springs requires worker decision-making and the design locations are not always achieved. Furthermore, securing metal spring elements to wood, which is often done by stapling, incurs the added risk of failure associated with the use of a non-uniform material (wood). While U.S. Pat. No. 3,680,157 overcomes these disadvantages by employing metal side, end and cross rails, it introduces other difficulties associated with the use of metal. Specifically, the end rails and the cross rails must be welded to the side rails, which increases the complexity and the cost of assembly. Also, an external tacking surface must be provided on the metal frame to which the covering fabric of the box spring assembly can be attached. In normal use, the box spring assembly is supported in a bed either on a conventional wooden bed frame or on a metal angle iron frame to which a headboard can be attached. Metal frame box spring assemblies can produce undesirable noise characteristics when used in connection with metal bed frames, and can cause damage to wooden bed frames under normal load conditions.

It is an object of the present invention, therefore, to provide an improved box spring assembly which attains the objectives of the metal frame box spring assembly while overcoming the disadvantages associated therewith.

SUMMARY OF THE INVENTION

This invention consists of a frame for a box spring assembly having wooden side and end rails, metal cross rails, and metal end rail mounting units secured to the end rails. The frame is generally rectangular and the side rails and end rail mounting units have top surfaces which are substantially coplanar. The box spring assembly includes a plurality of main springs and corner springs, each of which has a horizontal body portion and a depending mounting portion which terminates in a horizontal attaching portion. The metal cross rails and mounting units have substantially inverted U-shape cross sections comprising a horizontal top portion and depending leg portions. Each mounting unit top portion is provided with a plurality of upstruck flanges with slots located therein, the horizontal attaching portions of the corner springs and some of the main springs being arranged in frictional engagement with the ends of the slots to thereby secure the springs to the mounting unit. The cross rails are similarly provided with pairs of horizontally-spaced slots in the leg portions thereof, the horizontal attaching portions of others of the main springs being arranged in the slots to secure the springs to the cross rails.

The invention thus provides an improved box spring assembly which has wooden side and end rails and therefore realizes the advantages associated with their use; and further includes metal end rail mounting units which facilitate assembly and increase the structural capabilities of the box spring assembly. Upstruck flanges on the mounting units and slots arranged on the cross rails of the box spring assembly positively locate spring mounting positions and preclude worker decision-making. Springs are simply snapped into place on the cross rails and the mounting units, thus avoiding the stapling of metal spring elements to wood. The use of wooden side and end rails also precludes the necessity for welding of metal frame parts.

Further objects, features, and advantages of this invention will become apparent from the following description, the appended claims, and the accompanying drawing in which:

Figure 1:
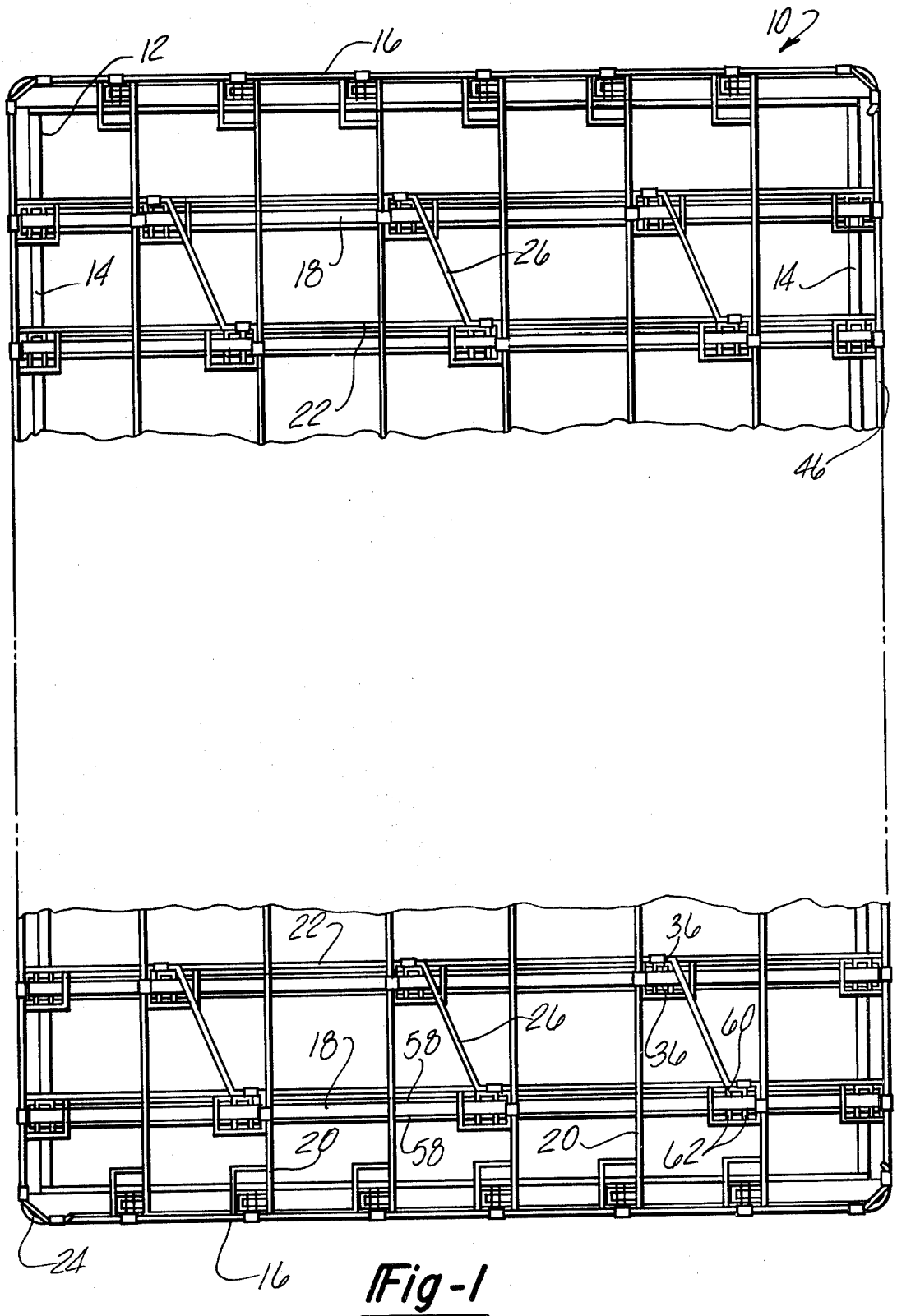
FIG. 1 is a plan view of the box spring assembly of this invention.

With reference to the drawing, the box spring assembly of this invention, indicated generally at 10 in FIG. 1, comprises a generally rectangular frame 12 consisting of a pair of wooden side rails 14, a pair of wooden end rails 16, a plurality of metal cross rails 18 secured to and extending between the side rails 14, longitudinal main springs 20 extending between the end rails 16, similar transverse main springs extending between the side rails 14, corner springs 24 secured to the frame 12 and a plurality of internal support springs 26 located within the boundary defined by the frame 12.

Figure 2:
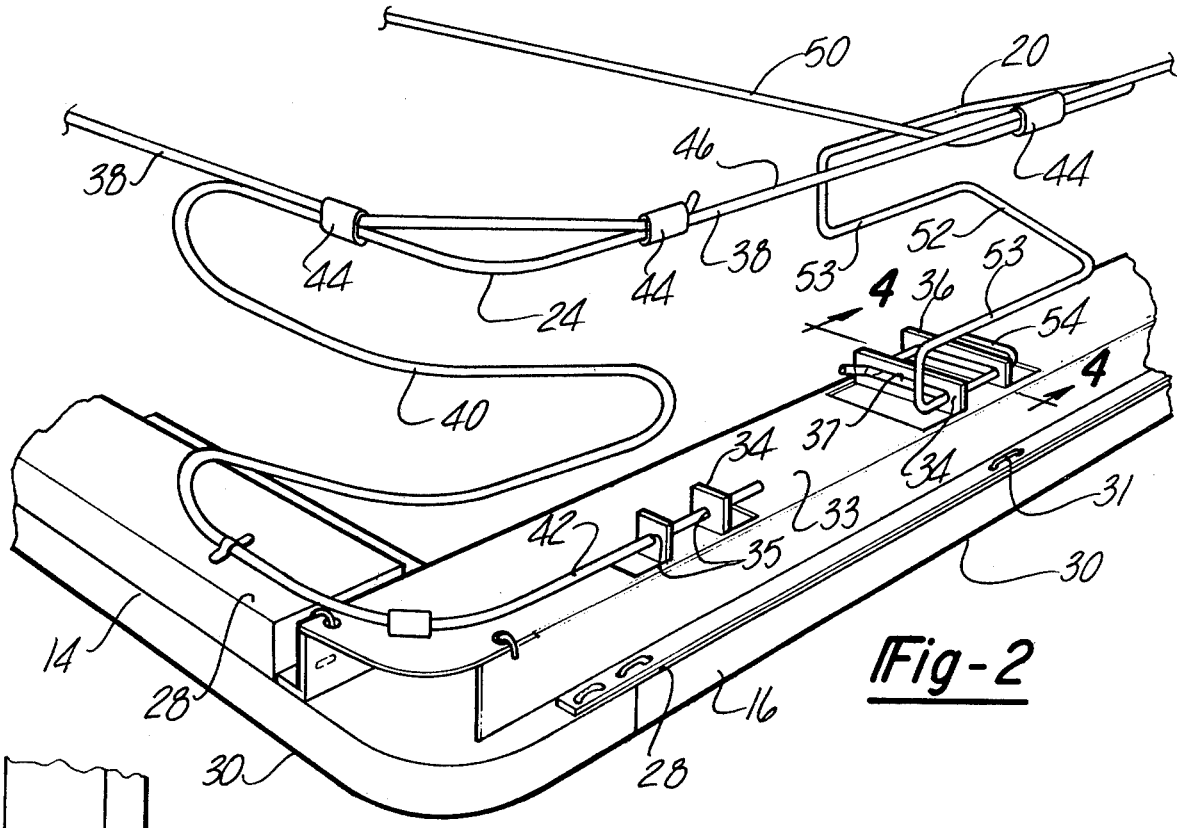
FIG. 2 is a fragmentary perspective view of one corner of the box spring assembly showing an end rail mounting unit and some of the box springs secured thereto.

As seen in FIG. 2, each side rail 14 and end rail 16 has a top surface 28 and a bottom surface 30. A metal end rail spring mounting unit 32 is mounted on the top surface 28 of each end rail 16, and is secured thereto by conventional means, such as by staples 31. The mounting unit 32 has a top surface 33 on which are provided a plurality of horizontally spaced first pairs of upstruck flanges 34 having horizontally aligned holes 35 formed therein. A pair of flanges 34 is formed at each end of the unit 32. Second pairs of horizontally spaced upstruck flanges 36, having horizontally aligned slots 37 formed therein, are located between the end pairs of flanges 34.

Figure 4:
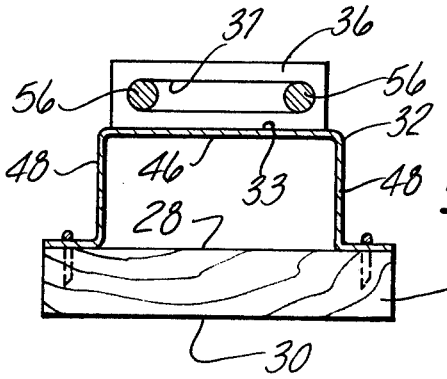
FIG. 4 is an enlarged sectional view of the end rail mounting unit as seen from substantially the line 4—4 in FIG. 2.

Each corner spring 24 has a horizontal body portion 38 and a depending mounting portion 40 which terminates in a substantially straight horizontal attaching portion 42. Each horizontal body portion 38 is secured to the portions 38 of adjacent corner springs 24 by means of clips 44 to provide a rectangular border wire 46 which is disposed above the outer periphery of the frame 12. It is seen (FIG. 4) that the mounting unit 32 has a substantially inverted U-shaped cross section comprising a horizontal top portion 46 and depending upright leg portions 48, so that the top surface 33 of the mounting unit 32 and the top surface 28 of the side rail 14 are substantially coplanar. Thus, the horizontal attaching portion 42 of the corner spring 24 fits into the slots 36 on a pair of flanges 34. The attaching portion 42 is stressed so that it frictionally engages the flanges 34 at the edges of the holes 35 thereby securing the corner spring 24 to the mounting unit 32 and thus to the frame 12.

Figure 3:
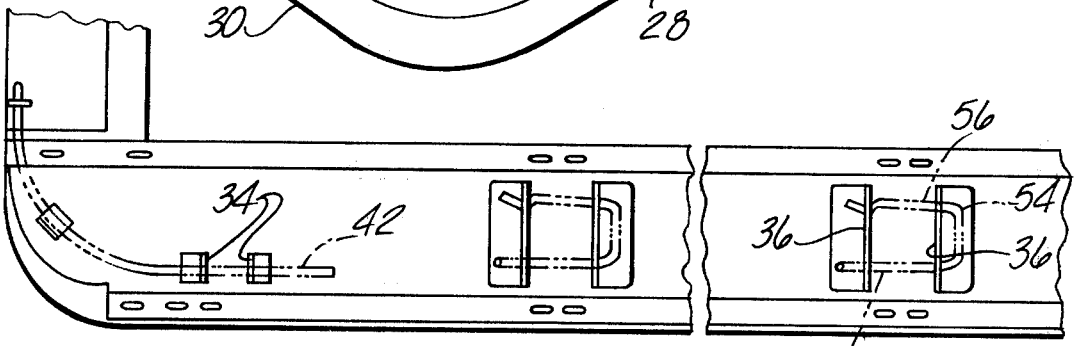
FIG. 3 is a fragmentary plan view of the end rail mounting unit of this invention.

FIG. 2 also shows that each longitudinal main spring 20 has a horizontal body portion 50 secured to the border wire 46 by clips 44, and a depending mounting portion 52 which includes a plurality of torsion bars 53 and terminates in a horizontal attaching portion 54. The attaching portion 54 is generally U-shaped (FIG. 3) and includes a pair of spaced legs 56. The legs 56 are spring stressed so that they tend to spring apart. The attaching portion 54 is positioned in the slots 37 of a pair of adjacent flanges 36 so that they frictionally engage the flanges at the ends of the slots 37, thereby securing the spring 20 to the mounting unit 32 and thus to the frame 12. FIG. 1 shows that a similar method is employed to position the transverse main springs 22 and the internal support springs 26 on the box spring assembly 10, as more particularly described in detail in U.S. Pat. No. 3,755,833. Each cross rail 18 is of a substantially U-shaped cross section which includes a pair of spaced upright legs 58. Pairs of horizontally-aligned slots, like the slots 37, are provided in the legs 58. Each of the springs 22 and 26 has a horizontal attaching portion 60 which is positioned in a pair of the cross rail slots. The attaching portion 60 is U-shaped, like the portion 54, and includes a pair of spaced legs 62. The legs 62 are spring biased and tend to spring apart so that they frictionally engage the rails at the ends of the slots and thereby secure the springs 22 and 26 to the cross rails 18. The cross rails 18 are mounted on the side rails 14 by conventional means, such as by stapling.

From the above description, it can be seen that this invention provides an improved box spring assembly 10 having a frame 12, the bottom surfaces 30 of which are entirely formed of wood. Metal end rail mounting units 32 and cross rails 18 are utilized to facilitate assembly and increase the structural capabilities of the box spring assembly 10. Spring mounting flanges 34 and 36 are arranged on the top surface 33 of the mounting units 32 to provide positive location of predetermined spring positions. Similar slots on the cross rails 18 locate other spring positions. Thus, in the spring assembly 10, all of the spring components are assembled directly on the frame 12 in pre-established locations that are fixed.

What is claimed is:

1. In a box spring assembly which includes a generally rectangular frame comprising side and end rails formed of wood and having substantially horizontal top surfaces, and a plurality of cross rails formed of metal extending between said side rails, corner wires secured to said frame and having horizontal body portions and depending mounting portions which terminate in substantially horizontal attaching portions, said horizontal body portions being connected to form a generally rectangular border wire disposed above the outer periphery of said frame, and main springs having horizontal body portions secured to said border wire and depending mounting portions which include a plurality of torsion bars and terminate in substantially horizontal attaching portions; the improvement comprising end rail spring mounting units formed of metal, each of said units being of a generally inverted U-shape in cross section having a substantially horizontal top portion and a pair of depending leg portions, said mounting units being secured to the end rails in positions such that the top portions of said mounting units and said top surfaces of said side rails are substantially coplanar, each of said mounting units extending between the side rails to the corners of said frame, and means forming pairs of aligned slots at evenly spaced locations on said mounting unit top portions, said horizontal attaching portions of said longitudinal main springs being located in said pairs of slots in frictional engagement with the ends thereof, thereby securing said longitudinal main springs to said end rail mounting units and thus to said frame.

2. A box spring assembly according to claim 1 wherein said mounting units are connected to said side rails, said depending legs of said mounting units being engaged with the top surfaces of said end rails, and further including means on said mounting units in which said attaching portions of said corner springs are located and confined.

3. A box spring assembly according to claim 1 wherein said means forming pairs of aligned slots on said end rail mounting units comprises upstruck flanges on said mounting unit top surfaces.

* * * * *